US005687898A

United States Patent [19]

Toulouse

[11] Patent Number: 5,687,898

[45] Date of Patent: Nov. 18, 1997

[54] FIXING APPARATUS WITH A COMPRESSED GAS-POWERED PISTON

[75] Inventor: Bruno Toulouse, Valence, France

[73] Assignee: Societe de Prospection et d'Inventions Techniques (SPIT), Bourg Les Valence, France

[21] Appl. No.: 590,312

[22] Filed: Jan. 23, 1996

[30] Foreign Application Priority Data

Feb. 15, 1995 [FR] France ..... 95 01712

[51] Int. Cl.[6] ..... B25C 1/04

[52] U.S. Cl. ..... 227/8; 227/10; 227/130

[58] Field of Search ..... 227/8, 9, 10, 130

[56] References Cited

U.S. PATENT DOCUMENTS

| | | | |
|---|---|---|---|
| 4,403,722 | 9/1983 | Nikolich . | |
| 4,483,473 | 11/1984 | Wagdy | 227/10 |
| 4,566,619 | 1/1986 | Kleinholz | 227/8 |
| 4,712,379 | 12/1987 | Adams et al. . | |
| 4,913,331 | 4/1990 | Utsumi et al. . | |
| 5,181,495 | 1/1993 | Gschwend et al. . | |
| 5,199,626 | 4/1993 | Terayama et al. . | |
| 5,213,247 | 5/1993 | Gschwend et al. | 227/10 |
| 5,558,264 | 9/1996 | Weinstein | 227/10 |

FOREIGN PATENT DOCUMENTS

| | | |
|---|---|---|
| 0056990 | 8/1982 | European Pat. Off. . |
| 00424941 | 5/1991 | European Pat. Off. . |
| 2076048 | 11/1981 | United Kingdom . |

*Primary Examiner*—Scott A. Smith
*Attorney, Agent, or Firm*—Schwartz & Weinrieb

[57] ABSTRACT

The gas admitted into the combustion chamber (10) is compressed by relative sliding of the cylinder (3) and the sleeve (4). Ignition is effected by a spark plug (13). During compression, the piston (35) is fixed in position by a retaining ring (32). The cylinder (3)/sleeve (4) assembly is connected to the housing (1) of the apparatus by return springs.

The apparatus is very suitable for fastening straps to steel or concrete.

24 Claims, 6 Drawing Sheets

FIXING APPARATUS WITH A COMPRESSED GAS-POWERED PISTON

FIELD OF THE INVENTION

This invention relates to an apparatus for fixing a plug by means of a compressed gas-powered piston, comprising a plug guide, a cylinder in which the piston is mounted, a sleeve for the combustion chamber which is slidably mounted so as to close the chamber at its rear together with a cylinder head carrying ignition means and at its front together with the piston and the cylinder when the apparatus is brought into the bearing position, a gas store, means for injecting the gas into the chamber, and a feeler for bringing the apparatus into the bearing position and closing the chamber.

An apparatus of this kind is disclosed and bought, inter alia, by U.S. Pat. No. 4,403,722.

BACKGROUND OF THE INVENTION

Apparatus of this type intended to fasten, for example, wood or straps to steel or concrete offer the advantage of great autonomy by virtue of the capacity of the gas storage cartridges with which they are equipped. Approximately one thousand shots can be fired with one single cartridge. However, these apparatus have the disadvantage of relatively limited power as a result, inter alia, of the excessively low calorific value of the gas.

The Applicant therefore wished to increase the power of the apparatus of the type mentioned hereinabove by proposing a solution directed toward to the problem of the compression of the gas after closure of the combustion chamber, this being completely independent of the teachings of U.S. Pat. No. 4,712,379, which have nothing to do with those of U.S. Pat. No. 4,403,722.

SUMMARY OF THE INVENTION

The apparatus of this invention is characterised in that the cylinder is mounted to move in translation within a housing of the apparatus, the plug guide acts as a feeler and is integral in translation with the cylinder, and means are provided for holding the piston in the cylinder.

By virtue of the mobility of the cylinder in the housing of the apparatus, the Applicant has therefore transformed the apparatus of U.S. Pat. No. 4,403,722 into a more powerful apparatus, the volume of the combustion chamber of which can be reduced after the closure thereof.

The cylinder can be integral with a front skirt slidably mounted on the rear housing.

However, in the preferred embodiment of the apparatus of the invention, the housing extends axially along the entire length of the sleeve and the entire length of the cylinder.

Means are advantageously provided to drive the sleeve towards the rear by means of the translation of the cylinder so as to bring the apparatus into the bearing position.

The action of the means for driving the sleeve towards the rear advantageously works against the action of means for returning the cylinder towards the front of the housing of the apparatus.

The means for driving the sleeve towards the rear again advantageously comprise at least one lever mounted to pivot on the cylinder against the action of a spring integral by means of its ends with the lever and the housing of the apparatus.

The cylinder is again advantageously slidably mounted in the sleeve, which includes a groove which is open towards the front in which a pin integral with the cylinder extends and which adapted not to come to a stop against the rear base of the groove until after closure of the chamber.

The cylinder is preferably mounted to slide towards the front in the sleeve by means of the return means in order to open the chamber at the front before it is opened at the rear by releasing the sleeve from the cylinder head.

A fan started by bringing the sleeve to a stop against the cylinder head when the apparatus is brought into the bearing position and therefore still operating when the chamber is opened at the front, can draw in fresh air by this means.

In order to form the means for holding the piston in the cylinder, the internal bore of the cylinder for receiving the piston can be enlarged towards the rear and can form a ramp and the piston can include an annular peripheral retaining recess in which a retaining segment adapted to cooperate with the ramp and to hold the piston when the cylinder is returned after closure of the chamber is disposed.

The piston is preferably provided in front of the retaining recess with an annular peripheral sealing recess in which a sealing segment adapted to cooperate with the wall of the internal bore of the cylinder is disposed.

The apparatus of U.S. Pat. No. 4,403,722, the cylinder of which has been rendered movable in the housing, therefore includes a combustion chamber with a volume which can be reduced in order to make the apparatus more powerful.

Departing from the same apparatus of U.S. Pat. No. 4,403,722, the same problem of increasing power can be solved in a slightly different manner from that claimed hereinbefore.

The apparatus of the type mentioned hereinabove can therefore also be perfected within the scope of this invention and can have a combustion chamber with a volume which can be reduced by virtue of the fact that, as the feeler is integral in translation with the sleeve, the cylinder is mounted to move in translation within the housing of the apparatus, the feeling action is successively ensured as a result of the feeler being integral with the sleeve and then by the plug guide when the apparatus is brought into the bearing position and means are provided for holding the piston in the cylinder.

In this case, the feeler which is integral with the sleeve preferably includes means adapted not to interfere with the feeling action of the plug guide.

BRIEF DESCRIPTION OF THE ILLUSTRATED EMBODIMENTS

The invention will be more readily understood with the aid of the following description of the preferred embodiment of the apparatus of the invention with reference to the accompanying drawings, in which like reference characters designate like or corresponding parts throughout the several views, and wherein.

DETAILED DESCRIPTION OF THE ILLUSTRATED EMBODIMENTS

Figure 1:
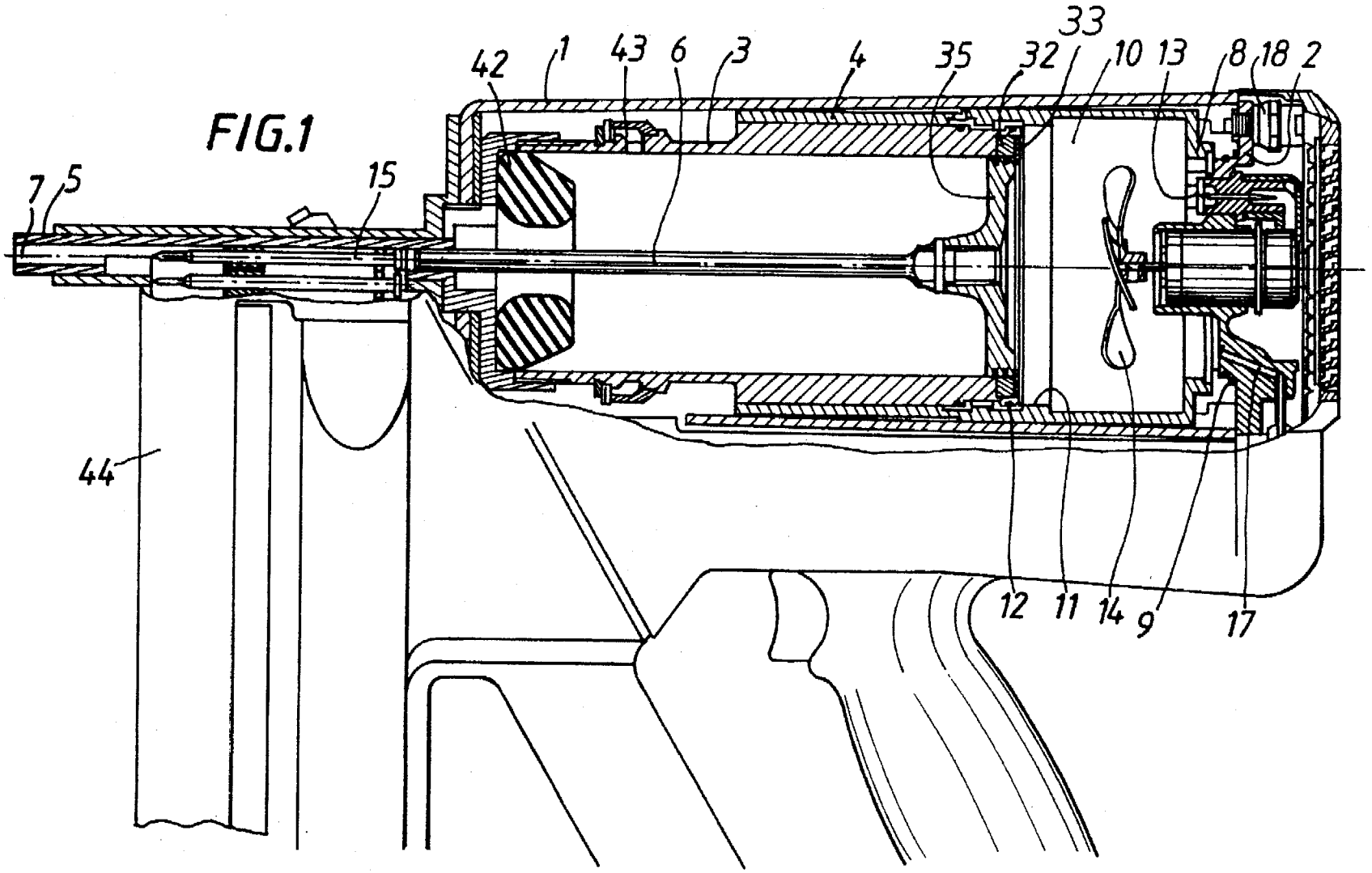
FIG. 1 is an axial section of a first embodiment of the apparatus, the combustion chamber being open.

The apparatus shown in the drawings will only be described with reference to those elements differing from those of U.S. Pat. No. 4,403,722, and of course with reference to the elements required for an understanding of the invention.

The apparatus essentially comprises a housing 1, a cylinder head 2, a cylinder 3, a sleeve 4, a plug guide 5 projecting partially from the housing 1, and a piston 6 for driving the plug, all of these elements having an axis 7. The piston 6 is slidably mounted in the cylinder 3 which is slidably mounted in the sleeve 4 which is itself slidably mounted in the housing 1. The relative sliding of the cylinder 3 and the sleeve 4 is nevertheless limited, as will be seen hereinafter. The plug guide 5 is screwed onto the cylinder 3.

The sleeve 4 is provided at its rear with a neck 8 which can come to a stop against a corresponding zone 9 of the cylinder head 2 in order to close a combustion chamber 10 at its rear. The sleeve 4 is also provided at its substantially central portion with an inner annular surface 11 adapted to receive a seal 12 carried in an annular recess at the rear of the cylinder 3 in order to close the combustion chamber 10 at the front.

An ignition spark plug 13 and a mixer fan 14 are carried by the cylinder head 2.

When a plug 15 is placed in the plug guide 5, the apparatus is brought to bear against the material 16 intended to receive the plug 15. The plug guide 5 then acts as a feeler.

An injection duct 17 opening into the combustion chamber 10 is formed through the cylinder head 2 for the admission of the propellant from a cartridge and a feeder (not shown).

The cylinder head 2 is provided with a switch 18 adapted to be actuated by the rear part of the sleeve 4 adjacent to its neck 8 when this neck 8 comes to a stop against the zone 9 of the cylinder head 2 for closing the chamber 10.

Figure 4:
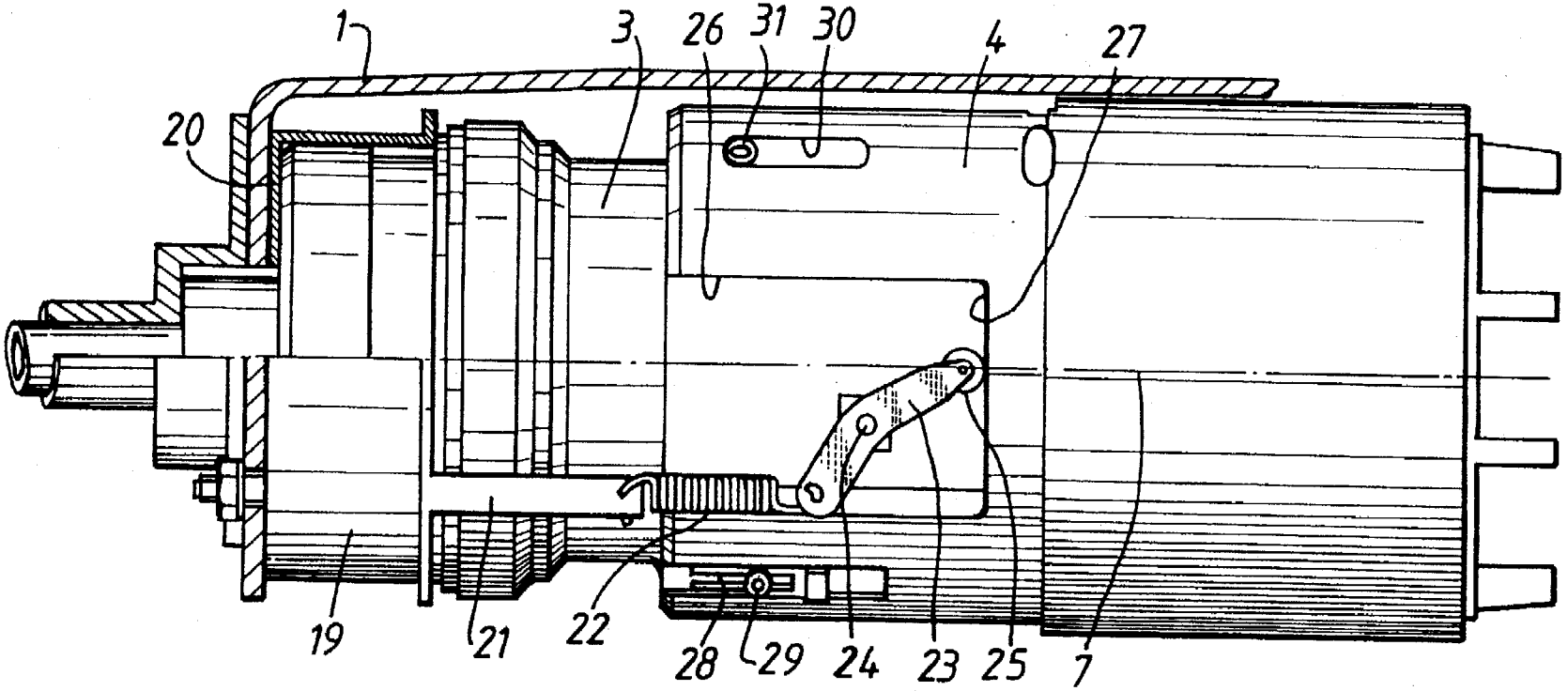
FIG. 4 is a partly sectional side view of the cylinder/sleeve assembly of the apparatus of FIGS. 1 to 3.

A plate 19 for returning the cylinder 3 towards the rear is threadedly mounted by means of its base 20 onto the housing 1 as seen in FIG. 4. It is extended towards the rear by two rods 21 which are diametrically opposite one another and are parallel to the axis 7, to the free ends of which one end of a pair of return springs 22 are respective is fixed. The other ends of the springs 22 are respectively fixed to a pair of lever 23 mounted to pivot on a pair of pins 24 driven substantially radially into the cylinder 3. The end of each lever 23 opposite the one to which the spring 22 is fixed is provided with a free bearing idler 25.

The sleeve 4 includes two wide lateral notches 26 around the levers 23 with a rear base 27 in a transverse plane against which the idler roller 25 bears.

The sleeve 4 also includes a groove 28 extending from its front edge parallel to the axis 7, and therefore open towards the front and in which a pin 29 screwed into the cylinder 3 is introduced and is adapted to come to a stop against the base of the groove when the apparatus is brought into the bearing position in order to limit the sliding of the cylinder 3 towards the rear once the sleeve 4 has come to a stop against the cylinder head 2.

The sleeve 4 also includes a closed port 30 parallel to the axis 7 into which another screw 31 screwed into the cylinder 3 is introduced and is adapted to cooperate with the front base of the port when the apparatus is opened at the end of the bearing operation in order to drive the sleeve 4 by the cylinder 3.

Figure 7:
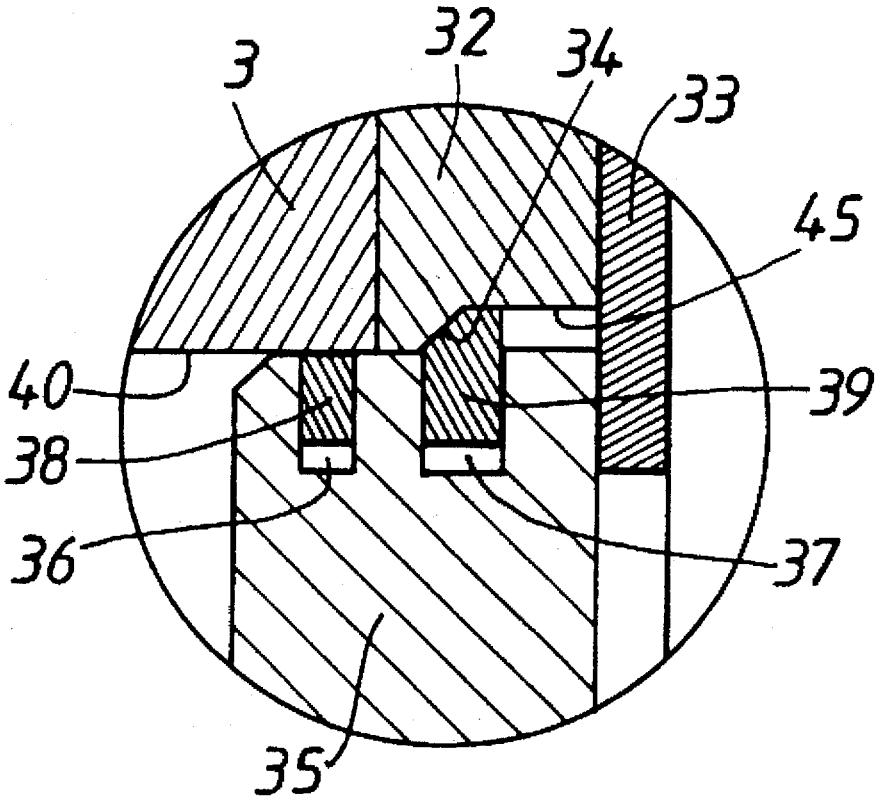
FIG. 7 is a sectional view on a larger scale of the rear portion of the cylinder in the closed position of the combustion chamber of the apparatus of FIGS. 1 to 6, and FIGS. 8A, 8B and 8C are diagrams illustrating the operation of a second embodiment of the apparatus of the invention.

The rear of the cylinder 3 includes an annular channel in which a retaining ring 32 for the 6 and a stop ring 33 for the 6 are housed, as best seen in FIG. 7. The first ring 32 aims to temporarily prevent relative sliding, towards the front, of the piston 6 in the cylinder 3 and the second ring 33 aims to prevent the piston 6 from emerging from the cylinder 3 towards the rear.

The ring 32 has an rear portion with an enlarged diameter 45 which is connected to the front portion with substantially the same diameter as that of the piston head 35 by means of a truncated ramp surface 34. The piston 6 includes an enlarged rear head 35 in which two annular peripheral recesses 36, 37 are formed, the first front recess receiving a sealing segment 38 and the second rear recess receiving a retaining segment 39. In the rest state, the retaining segment 39 projects out of its recess.

Following the description of the structure of the fixing apparatus with an internal combustion engine, its operation will now be described.

Bearing position

In the rest position, the cylinder 3 is returned by the springs 22 towards the front against the housing 1 by means of the interaction of the plate 19 and the plug guide 5 (FIG. 1).

Figure 2:
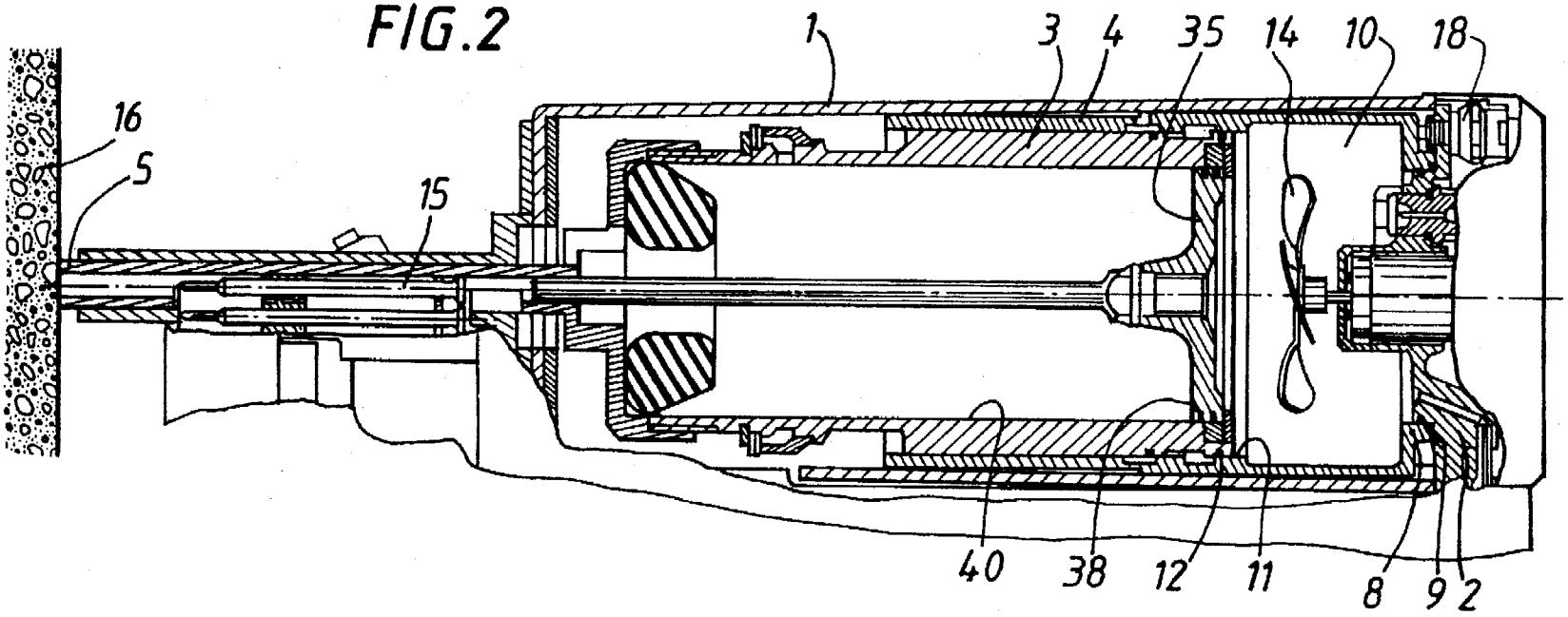
FIG. 2 is a view similar to FIG. 1, the combustion chamber being closed.

When the apparatus is brought to bear against the material 16 intended to receive a plug 15, the plug guide 5 acting as a feeler drives the cylinder 3 towards the rear in the housing 1 and, by means of the levers 23 and notches 26, drives the sleeve 4 rearwardly until the latter comes to bear by means of its neck 8 against the zone 9 of the cylinder head 2 and closes the rear of the combustion chamber 10 (FIG. 2). During this return movement, the gas cartridge releases a dose of gas into the combustion chamber 10. At the end of the return movement of the sleeve 4, the fan 14 is started by means of the switch 18 in order to agitate the air/gas mixture and the seal 12 of the cylinder 3 is situated just in front of the annular surface 11 of the sleeve 4 and the combustion chamber 10 is closed at the front by contact between the seal 12 of the cylinder 3 and the surface 11 of the sleeve 4 and contact between the sealing segment 38 of the piston 35 and the internal bore 40 of the cylinder 3.

The cylinder/sleeve assembly 3, 4 is returned from the position of FIG. 1 to that of FIG. 2 against the action of the springs 22 which are gradually tensioned by pivoting the levers 23.

Figure 3:
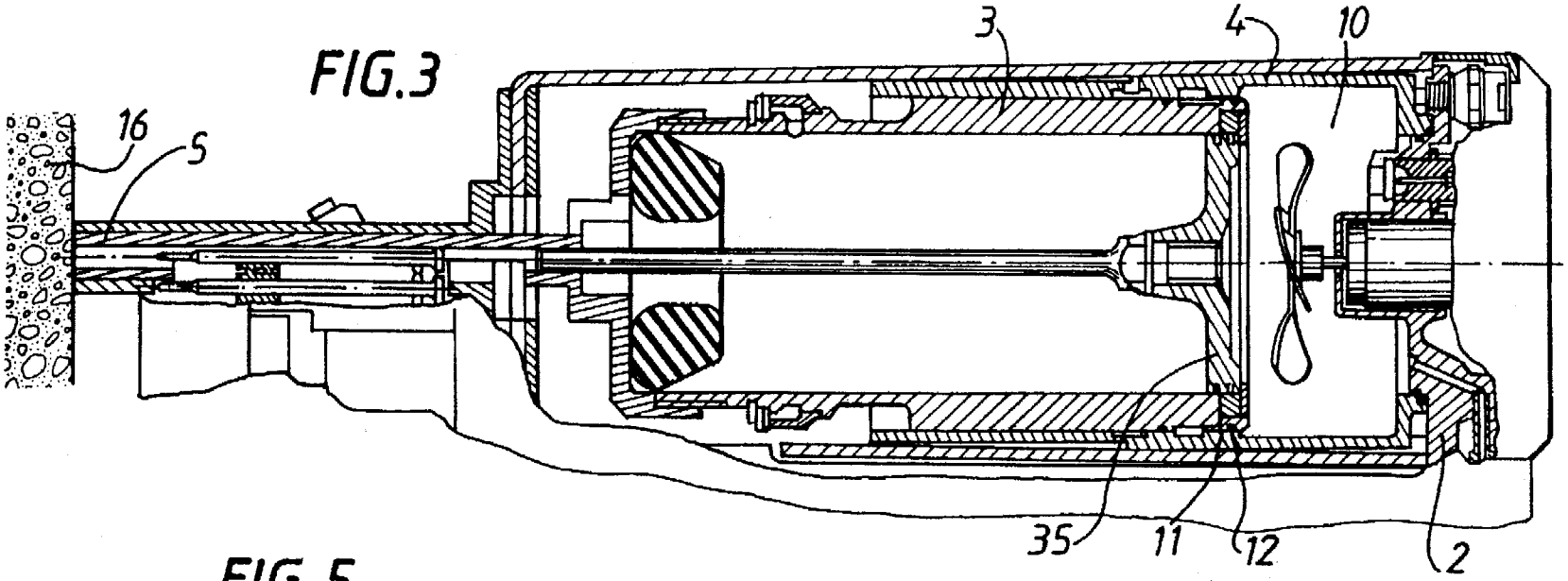
FIG. 3 is a view similar to FIG. 2 at the end of the bearing operation, the combustion chamber still being closed and having a reduced volume.
Figure 6:
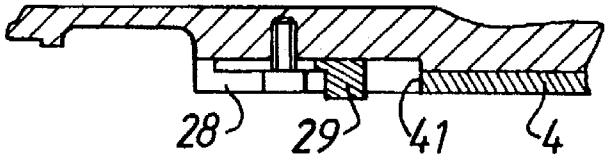
FIG. 6 is a sectional view on a larger scale of the mechanism for stopping the return of the cylinder of the apparatus of FIGS. 1 to 5.
Figure 5:
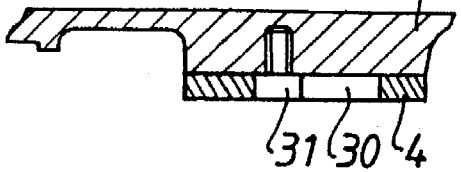
FIG. 5 is a sectional view on a larger scale of the mechanism for driving the sleeve towards the front by the cylinder of the apparatus of FIGS. 1 to 4.

After closing the chamber 10 and continuing to bring the apparatus to bear against the material 16, the operator reduces the volume of the chamber 10 in order to further compress the propellant. As the sleeve 4 is fixed in position against the cylinder head 2, the plug guide 5 continues to move the cylinder 3 rearwardly until the pin 29 integral with the cylinder 3 comes to a stop against the rear base 41 of the groove 28 of the sleeve 4 as seen in FIG. 6. During this displacement of the cylinder 3 from the position of FIG. 2 to that of FIG. 3, the seal 12 of the cylinder 3 slides against the surface 11 of the sleeve 4 until it is situated to the rear of the latter, reducing the volume of the chamber 10 accordingly. The piston 35 remains integral with the cylinder 3 during such movement of the latter by virtue of the fact that the retaining segment 39 is held by the ramp 34 of the ring 32.

Firing

Firing takes place upon ignition of the spark plug 13. A spark generates an explosion which creates a pressure greater than the force of the retaining segment 39. The latter withdraws into its recess 37, sliding on the ramp 34 and the piston 35 is therefore released from the retaining ring 32. During the stroke of the piston 35, the segment 39 behaves like a conventional segment.

The piston rod 6 strikes the plug 15 which is embedded into the material 16. The piston 6 continues its stroke until its head 35 bears against the damper 42.

When the piston head 35 passes beyond an exhaust valve 43 of the cylinder 3, the gases escape, the "engine" cools down rapidly and a negative pressure closes the valve 43 and returns the piston 35 to the rear into the firing position against the stop ring 33. The retaining segment 39 is expanded in order to hold the piston 35 behind the ramp 34 of the retaining ring 32.

The cylinder/sleeve assembly does not move during this reciprocating movement of the piston 6, 35.

End of the bearing operation

The levers 23 push the sleeve 4 towards the rear at a stop against the cylinder head 2 by means of the springs 22 which are relaxed. The cylinder 3 is returned towards the front relative to the sleeve 4 by means of the springs 22. Just after the components of the apparatus have returned to their position of FIG. 2, the combustion chamber 10, closed at the rear, is opened at the front and the fan 14 expels the burnt gases through the ports formed in the sleeve 4.

Immediately after the cylinder 3 starts to drive the sleeve 4, the combustion chamber 10 is also opened at the rear by releasing the neck 8 of the sleeve 4 from the zone 9 of the cylinder head 2 and the fan 14 draws in fresh air through the ports formed in the cylinder head 2.

When the screw 31 comes to a stop against the front base of the port 30 of the sleeve 4, the latter is driven towards the front by the cylinder 3 until the latter returns to the rest position against the housing 1, ready to fasten a new plug 15 from the loader 44.

It will be noted that the pin 29 allows for adjustment of the compression rate and that if this rate has not been changed it will be possible to provide other even simpler means to limit the sliding of the cylinder towards the rear.

The relative dimensions of the piston head 35, the retaining ring 32, and its ramp 34 are adapted to the desired retaining force. The ring 32 must be regarded as a wearing part, and the cylinder 3 and the rings 32, 33 could be one single component.

In the example hereinabove, two sealing surfaces comprising the surface 11 are provided on the sleeve 4, these being axially offset. A better compression rate can be obtained by this means.

Figure 8A:
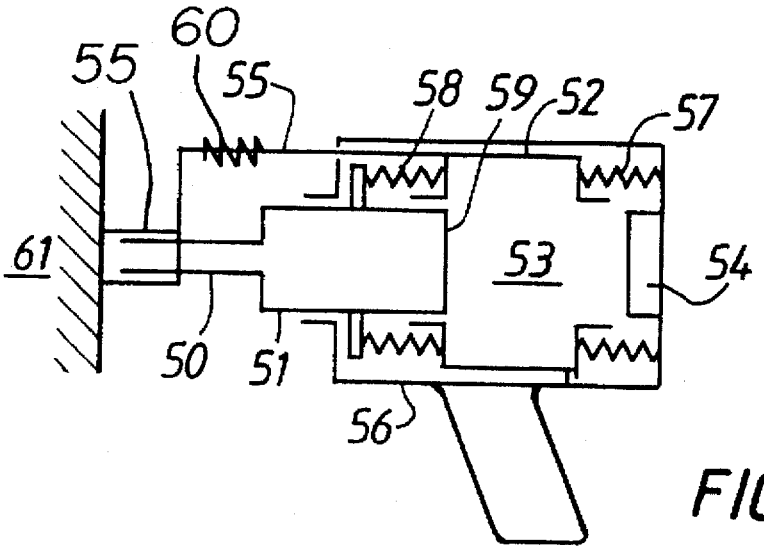
Figure 8B:
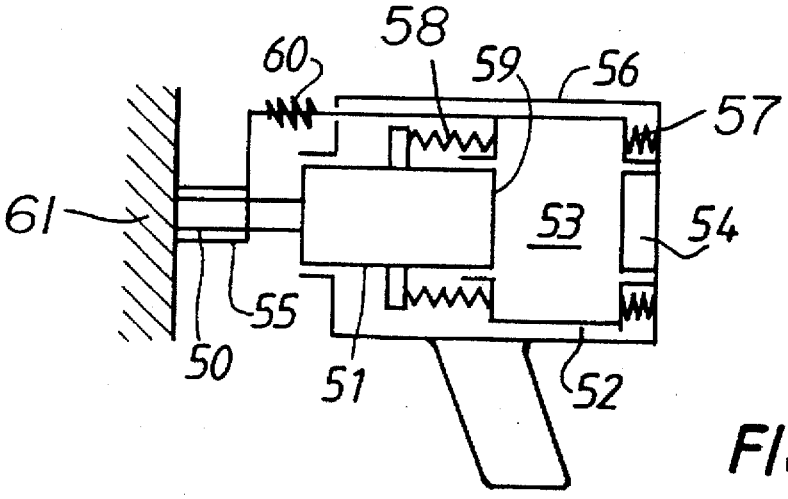
Figure 8C:
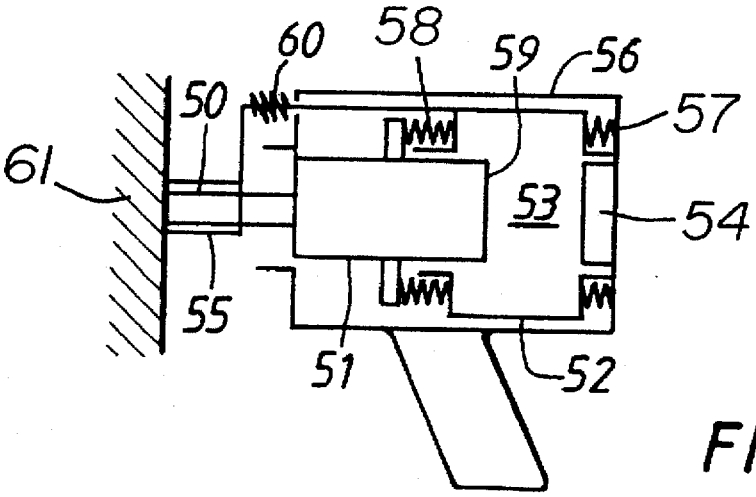

In the embodiment of FIGS. 8A, 8B and 8C, the apparatus of the invention is essentially no different from that of FIGS. 1–7. It differs essentially in that it is a little closer to the starting apparatus of the document U.S. Pat. No. 4,403,722, the feeler remaining integral with the sleeve.

The apparatus of FIGS. 8A–8C comprises a plug guide 50, a cylinder 51 in which a piston is mounted with means for holding it in the cylinder 51, a sleeve 52 for the combustion chamber 53, a cylinder head 54, a gas store, means for injecting the gas into the chamber 53 and a feeler 55. The feeler 55 is integral in translation with the sleeve 52. The sleeve 52 is mounted to slide in the housing 56 against return means 57. The cylinder 51 is mounted to move in translation relative to the sleeve 52 against return means 58.

When the apparatus is brought into the bearing position, the feeler 55 starts to push the sleeve 52 back towards the rear in order to close the chamber 53 at the rear together with the cylinder head 54. When the plug guide 50 comes into contact with the material substrate 61 against which the apparatus is brought to bear, the plug guide 50 therefore acts as a feeler in order to drive the cylinder 51 and the piston 59 towards the rear and ultimately to close the chamber 53 at the front together with the piston 59 and the cylinder 51 (FIG. 8B).

Once the apparatus has been brought into the bearing position, the plug guide 50 continues to drive the cylinder 51 and the piston 59 towards the rear in the sleeve 52 in order to reduce the volume of the chamber 53 (FIG. 8C).

As soon as the plug guide 50 also starts to act as a feeler, the feeler 55 proper does not have to fulfil this function. It is for this reason that the feeler 55 includes means to this end. In this case, it includes a compressible intermediate spring 60. However, it could also have a telescopic part.

Obviously, many modifications and variations of the present invention are possible in light of the above teachings. It is therefore to be understood that in accordance with the scope of the appended claims, the present invention may be practiced otherwise than as specifically described herein.

I claim:

1. Apparatus for securing an element within a substrate, comprising:

a housing having a longitudinal axis;

a sleeve member disposed within said housing;

a combustion chamber defined within said sleeve member;

a cylinder disposed within said sleeve member;

a guide member, for gliding an element as said element is being driven by said apparatus into a substrate, fixedly attached at one end thereof to said cylinder and having a second end thereof for engaging a substrate; and a piston axially movable within said cylinder for movement between a first ready position at which said piston is disposed so as to subsequently drive an element, disposed within said guide member, into a substrate, and a second fired position at which said piston drives an element, disposed within said guide member, through said guide member and into a substrate;

said cylinder being axially movable within said sleeve member, as a result of said guide member engaging said substrate, between a first position at which said cylinder cooperates with said sleeve member so as to sealingly close one end of said combustion chamber, and a second position at which said cylinder continues to cooperate with said sleeve member so as to maintain said one end of said combustion chamber sealed closed and reduces the volume of said combustion chamber prior to ignition of a combustible charge within said combustion chamber so as to increase the combustion power developed within said combustion chamber and imparted to said piston, and an element driven thereby, when a combustible charge is ignited within said combustion chamber.

2. Apparatus as set forth in claim 1, further comprising:

a cylinder head fixedly mounted within said housing; and said sleeve member is axially movable within said housing between a first position at which said sleeve member is disengaged from said cylinder head so as to open a second end of said combustion chamber, and a second position at which said sleeve member is engaged with said cylinder head so as to sealingly close said second end of said combustion chamber.

3. Apparatus as set forth in claim 2, further comprising:

ignition means mounted upon said cylinder head for igniting a combustible charge within said combustion chamber.

4. Apparatus as set forth in claim 3, further comprising:

fan means mounted upon said cylinder head for mixing a combustible charge with air within said combustion chamber.

5. Apparatus as set forth in claim 4, further comprising:

switch means mounted upon said cylinder head for engagement by said sleeve member when said sleeve member is moved to said second position so as to actuate operation of said fan means.

6. Apparatus as set forth in claim 2, further comprising:

means interconnecting said cylinder and said sleeve member such that said sleeve member is engaged with said cylinder head so as to close said second end of said combustion chamber prior to said cylinder moving to said first position at which said cylinder cooperates with said sleeve member so as to sealingly close said one end of said combustion chamber prior to ignition of a combustible charge within said combustion chamber, and for moving said cylinder relative to said sleeve member so as to open said one end of said combustion chamber prior to disengagement of said sleeve member from said cylinder head, so as to open said second end of said combustion chamber, subsequent to ignition of a combustible charge within said combustion chamber and movement of said piston to said second fired position.

7. Apparatus as set forth in claim 6, wherein said means interconnecting said cylinder and said sleeve member comprises:

notch means defined within side portions of said sleeve member;

lever means pivotably mounted upon said cylinder and disposed within said notch means of said sleeve member;

roller means mounted upon one end of said lever means for rollably engaging said notch means of said sleeve member; and spring means connected at one end thereof to a second end of said lever means, and connected at a second end thereof to said housing.

8. Apparatus as set forth in claim 1, further comprising:

means defined between said piston and said cylinder for releasably retaining said piston at said first ready position prior to ignition of a combustible charge within said combustion chamber, and for permitting release of said piston from said first ready position, with respect to said cylinder, for movement within said cylinder to said second fired position under the influence of the combustion power developed within said combustion chamber when a combustible charge is ignited within said combustion chamber.

9. Apparatus as set forth in claim 8, wherein said means for releasably retaining said piston comprises:

an annular recess defined within said piston;

an annular recessed portion defined within said cylinder; and a radially expandable-contractable retaining segment disposed within said annular recess of said piston, and engageable with and disengageable from said annular recessed portion of said cylinder for respectively retaining said piston at said first ready position prior to ignition of a combustible charge within said combustion chamber when said retaining segment is radially expanded, and for releasing said piston as a result of radially contracting into said annular recess of said piston under the influence of the combustion power developed within said combustion chamber when a combustible charge is ignited within said combustion chamber.

10. Apparatus as set forth in claim 9, wherein:

said recessed portion of said cylinder comprises an inclined ramp portion; and said retaining segment of said piston comprises a complementary inclined ramp portion for cooperation with said inclined ramp portion of said recessed portion of said cylinder.

11. Apparatus for securing an element within a substrate, comprising:

a housing having a longitudinal axis;

a sleeve member disposed within said housing;

a combustion chamber defined within said sleeve member;

a cylinder axially movable within said sleeve member between a first position at which said cylinder cooperates with said sleeve member so as to sealingly close one end of said combustion chamber, and a second position at which said cylinder continues to cooperate with said sleeve member so as to maintain said one end of said combustion chamber sealed closed and reduces the volume of said combustion chamber prior to ignition of a combustible charge within said combustion chamber so as to increase the combustion power developed within said combustion chamber, for driving an element into a substrate, when a combustible charge is ignited within said combustion chamber;

a piston axially movable within said cylinder for movement between a first ready position at which said piston is disposed so as to subsequently drive an element into a substrate, and a second fired position at which said piston drives an element into a substrate; and a guide member, for guiding an element as said element is being driven by said piston into a substrate, fixedly attached at one end thereof to said cylinder and having a second end thereof for engaging a substrate, into which an element is to be driven, so as to axially move said cylinder to said first and second positions with respect to said sleeve member in response to said second end of said guide member engaging a substrate and said housing of said apparatus being moved toward said substrate.

12. Apparatus as set forth in claim 11, further comprising:

a cylinder head fixedly mounted within said housing; and said sleeve member is axially movable within said housing between a first position at which said sleeve member is disengaged from said cylinder head so as to open a second end of said combustion chamber, and a second position at which said sleeve member is engaged with said cylinder head so as to sealingly close said second end of said combustion chamber.

13. Apparatus as set forth 12, further comprising:

means interconnecting said cylinder and said sleeve member such that said sleeve member is engaged with said cylinder head so as to close said second end of said combustion chamber prior to said cylinder moving to said first position at which said cylinder cooperates with said sleeve member so as to sealingly close said one end of said combustion chamber prior to ignition of a combustible charge within said combustion chamber, and for moving said cylinder relative to said sleeve member so as to open said one end of said combustion chamber prior to disengagement of said sleeve member from said cylinder head, so as to open said second end of said combustion chamber, subsequent to ignition of a combustible charge within said combustion chamber and movement of said piston to said second fired position.

14. Apparatus as set forth in claim 13, wherein said means interconnecting said cylinder and said sleeve member comprises:

notch means defined within side portions of said sleeve member;

lever means pivotably mounted upon said cylinder and disposed within said notch means of said sleeve member;

a roller means mounted upon one end of said lever means for rollably engaging said notch means of said sleeve member; and spring means connected at one end thereof to a second end of said lever means, and connected at a second end thereof to said housing.

15. Apparatus as set forth in claim 11, further comprising:

means defined between said piston and said cylinder for releasably retaining said piston at said first ready position prior to ignition of a combustible charge within said combustion chamber, and for permitting release of said piston from said first ready position, with respect to said cylinder, for movement within said cylinder to said second fired position under the influence of the combustion power developed within said combustion chamber when a combustible charge is ignited within said combustion chamber.

16. Apparatus as set forth in claim 15, wherein said means for releasably retaining said piston comprises:

an annular recess defined within said piston;

an annular recessed portion defined within said cylinder; and a radially expandable-contractable retaining segment disposed within said annular recess of said piston, and engageable with and disengageable from said annular recessed portion of said cylinder, for respectively retaining said piston at said first ready position prior to ignition of a combustible charge within said combustion chamber when said retaining segment is radially expanded and for releasing said piston as a result of radially contracting into said annular recess of said piston under the influence of the combustion power developed within said combustion chamber when a combustible charge is ignited within said combustion chamber.

17. Apparatus as set forth in claim 16, wherein:

said recessed portion of said cylinder comprises an inclined ramp portion; and said retaining segment of said piston comprises a complementary inclined ramp portion for cooperation with said inclined ramp portion of said recessed portion of said cylinder.

18. Apparatus for securing an element within a substrate, comprising:

a housing having a longitudinal axis;

a sleeve member disposed within said housing;

a combustion chamber defined within said sleeve member;

a cylinder disposed within said housing;

a piston axially movable within said cylinder for movement between a first ready position at which said piston is disposed so as to subsequently drive an element into a substrate, and a second fired position at which said piston drives an element into a substrate;

means mounting said cylinder within said housing for axial movement with respect to said sleeve member between a first position at which said cylinder cooperates with said sleeve member so as to sealingly close one end of said combustion chamber, and a second position at which said cylinder continues to cooperate with said sleeve member so as to maintain said one end of said combustion chamber sealed closed and reduces the volume of said combustion chamber prior to ignition of a combustible charge within said combustion chamber so as to increase the combustion power developed within said combustion chamber, and imparted to said piston for driving an element into a substrate, when a combustible charge is ignited within said combustion chamber; and a guide member, for guiding an element as said element is being driven by said piston into a substrate, fixedly attached at one end thereof to said cylinder and having a second end thereof for engaging a substrate, into which an element is to be driven by said piston, so as to axially move said cylinder to said first and second positions with respect to said sleeve member in response to said second end of said guide member engaging a substrate and said housing of said apparatus being moved toward said substrate.

19. Apparatus as set forth in claim 18, further comprising:

a cylinder head fixedly mounted within said housing; and said sleeve member is axially movable within said housing between a first position at which said sleeve member is disengaged from said cylinder head so as to open a second end of said combustion chamber, and a second position at which said sleeve member is engaged with said cylinder head so as to sealingly close said second end of said combustion chamber.

20. Apparatus as set forth in claim 19, further comprising:

feeler means operatively connected to said sleeve member for engaging a substrate and thereby moving said sleeve member to said second position when said housing of said apparatus is moved toward said substrate.

21. Apparatus as set forth in claim 20, further comprising:

means interconnecting said feeler means and said sleeve member for permitting said feeler means to move axially relative to said sleeve member after said sleeve member has been moved to said second position as a result of said housing of said apparatus being moved toward said substrate so as not to interfere with said movement of said cylinder to said second position in response to movement of said housing of said apparatus toward said substrate while said second end of said guide member is engaged with said substrate.

22. Apparatus as set forth in claim 21, wherein:

said means interconnecting said feeler means and said sleeve member comprises compressible spring means.

23. Apparatus as set forth in claim 18, further comprising:

spring means interposed between said sleeve member and said cylinder head for biasing said sleeve member toward said first position.

24. Apparatus as set forth in claim 18, further comprising:

spring means interposed between said cylinder and said sleeve member for biasing said cylinder in a direction from said second position of said cylinder toward said first position of said cylinder.

* * * * *